US005199806A

United States Patent [19]

Fujioka et al.

[11] Patent Number: 5,199,806

[45] Date of Patent: Apr. 6, 1993

[54] APPARATUS FOR FEEDING INDIVIDUAL SHEETS OF PAPER AS WELL AS CONTINUOUS FAN FOLD PAPER UTILIZING A PLATEN

[75] Inventors: Satoshi Fujioka; Tatsuya Seshimo; Koichiro Yokoyama, all of Suwa, Japan

[73] Assignee: Seiko Epson Corporation, Tokyo, Japan

[21] Appl. No.: 626,378

[22] Filed: Dec. 12, 1990

Related U.S. Application Data

[63] Continuation of Ser. No. 494,998, Mar. 16, 1990, abandoned, which is a continuation of Ser. No. 210,440, Jun. 23, 1988, abandoned.

[30] Foreign Application Priority Data

| | | | |
|---|---|---|---|
| Jun. 30, 1987 | [JP] | Japan | 62-163495 |
| Jun. 30, 1987 | [JP] | Japan | 62-163496 |
| Jul. 15, 1987 | [JP] | Japan | 62-176404 |
| Jul. 15, 1987 | [JP] | Japan | 62-176405 |

[51] Int. Cl.[5] ..... B41J 11/28

[52] U.S. Cl. ..... 400/616; 400/616.3; 400/636; 400/636.2; 400/637.1; 400/639.1

[58] Field of Search ..... 400/70, 76, 549, 551, 400/568, 578, 583, 583.4, 605, 616, 616.1, 616.2, 616.3, 636, 636.2, 637.1, 639.1, 639.2, 708

[56] References Cited

U.S. PATENT DOCUMENTS

| | | | |
|---|---|---|---|
| 3,722,655 | 3/1973 | Singer | 400/636 X |
| 4,026,405 | 5/1977 | de Poncins | 400/616.3 X |
| 4,085,837 | 4/1978 | Takano et al. | 400/568 X |
| 4,195,940 | 4/1980 | Rekewitz | 400/568 |
| 4,197,024 | 4/1980 | Huntoon | 400/636 |
| 4,266,880 | 5/1981 | Buchanan | 400/568 X |
| 4,569,611 | 2/1986 | Watanabe et al. | 400/639.1 X |
| 4,657,420 | 4/1987 | Kondo | 400/639.1 X |
| 4,684,277 | 8/1987 | Edstrom et al. | 400/639.1 |
| 4,688,957 | 8/1987 | Prevignano | 400/616 |
| 4,753,380 | 6/1988 | Mitcham | 400/616.1 |
| 4,761,087 | 8/1988 | Ward et al. | 400/616.1 X |

FOREIGN PATENT DOCUMENTS

| | | | |
|---|---|---|---|
| 540076 | 12/1931 | Fed. Rep. of Germany | 400/639.1 |
| 3606060 | 4/1987 | Fed. Rep. of Germany | 400/616.3 |
| 0174374 | 10/1984 | Japan | 400/637.1 |
| 0049876 | 3/1986 | Japan | 400/639.1 |
| 0053071 | 3/1986 | Japan | 400/639.1 |
| 0064474 | 4/1986 | Japan | 400/639.1 |
| 0132361 | 6/1986 | Japan | 400/616.3 |

OTHER PUBLICATIONS

IBM Technical Disclosure Bulletin, "Non-Shingling Forms-Feed Tractor", vol. 27, No. 12, May 1985, p. 7111.

IBM Technical Disclosure Bulletin, "Torque Sensing and Control," vol. 29, No. 11, Apr. 1987, pp. 4771–4773.

*Primary Examiner*—Edgar S. Burr
*Assistant Examiner*—John S. Hilten
*Attorney, Agent, or Firm*—Blum Kaplan

[57] ABSTRACT

A paper feeding apparatus for feeding fanfold paper to a printer is provided. A cylindrical platen is rotatably mounted in the printer. A paper feeding tractor is provided upstream from the platen in a paper feeding direction. A power mechanism drives the platen and the paper feeding tractor. A pair of rollers is located above the platen downstream from the platen in the paper feeding direction. One of the rollers is coupled to the power mechanism causing it to rotate with a circumferential speed which is greater than or equal to the circumferential speed of the platen. A pressing member presses the fanfold paper which is fed out from the platen towards the rollers.

11 Claims, 10 Drawing Sheets

FIG. 3
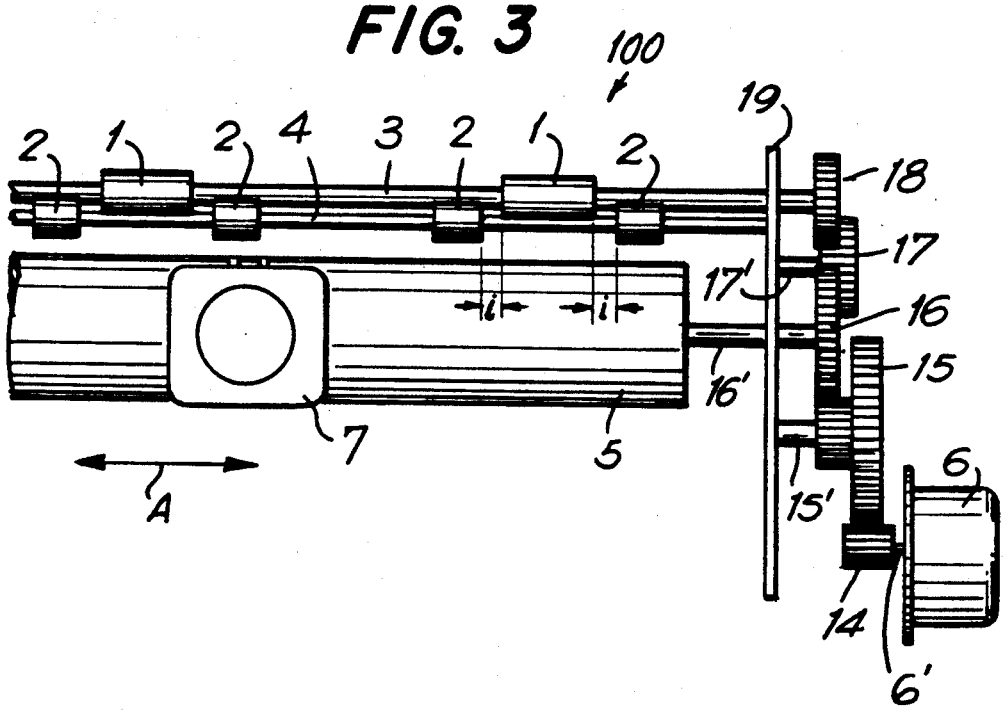
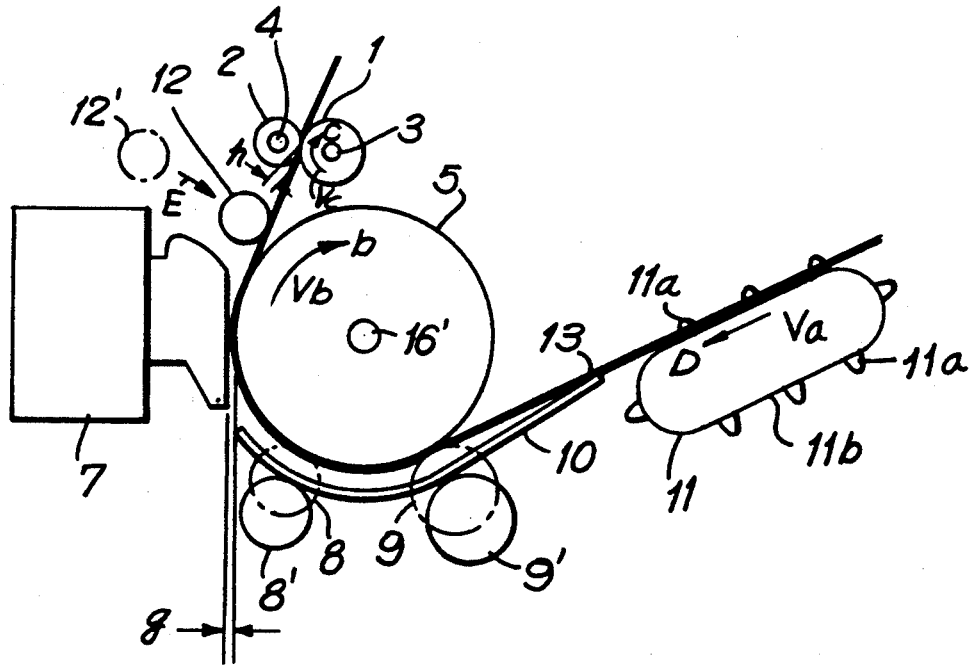
FIG. 4

FIG. 5
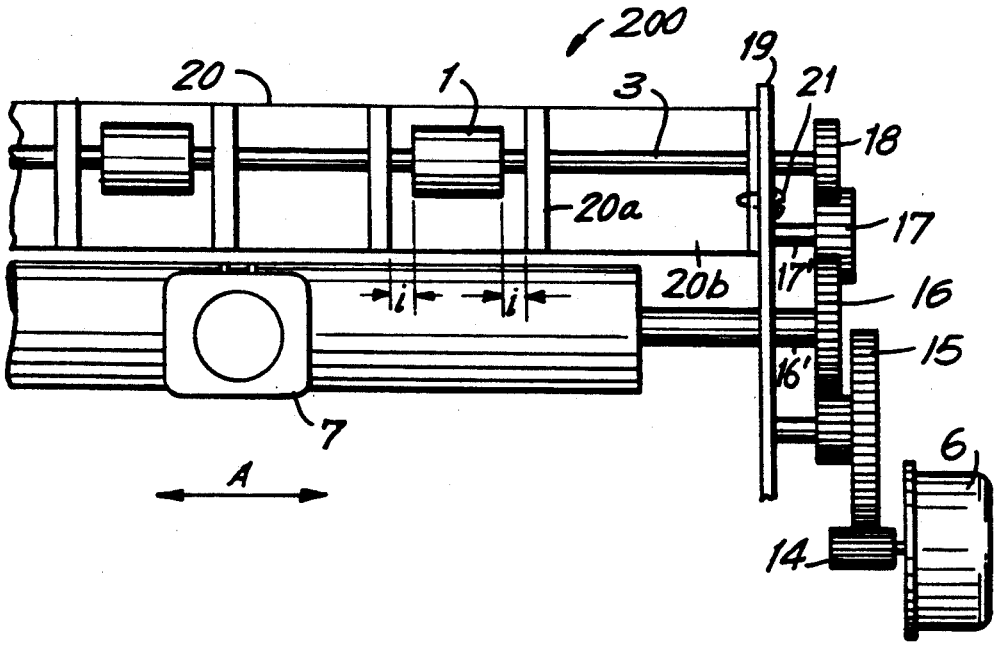
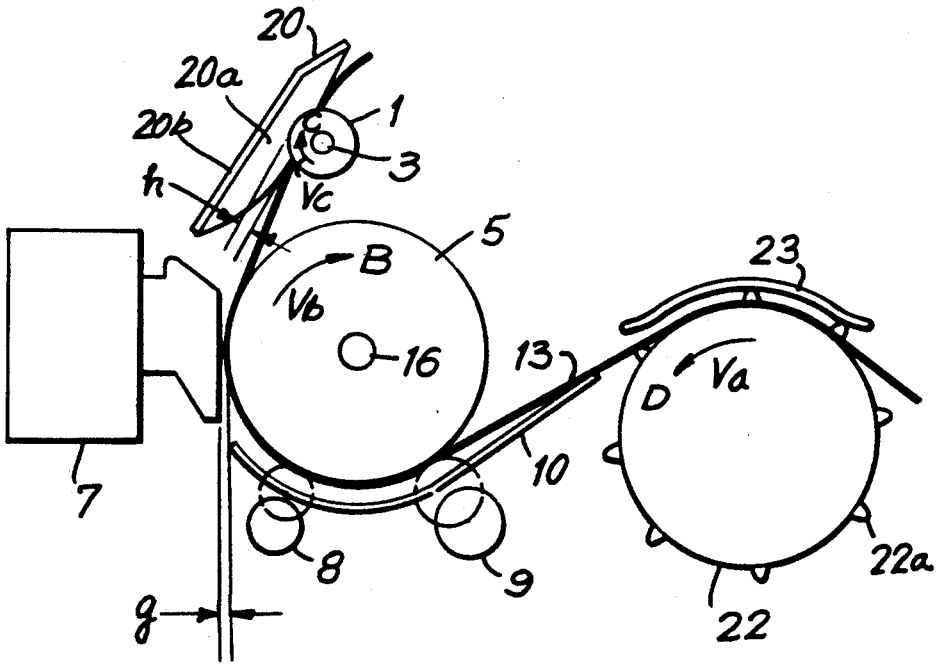
FIG. 6

FIG. 7
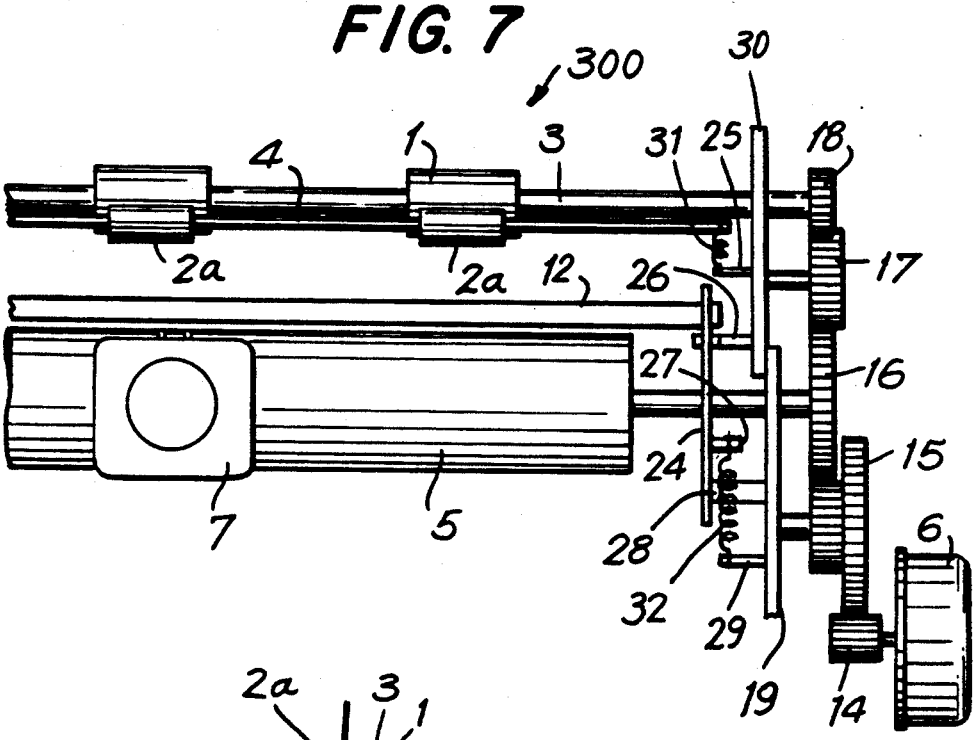
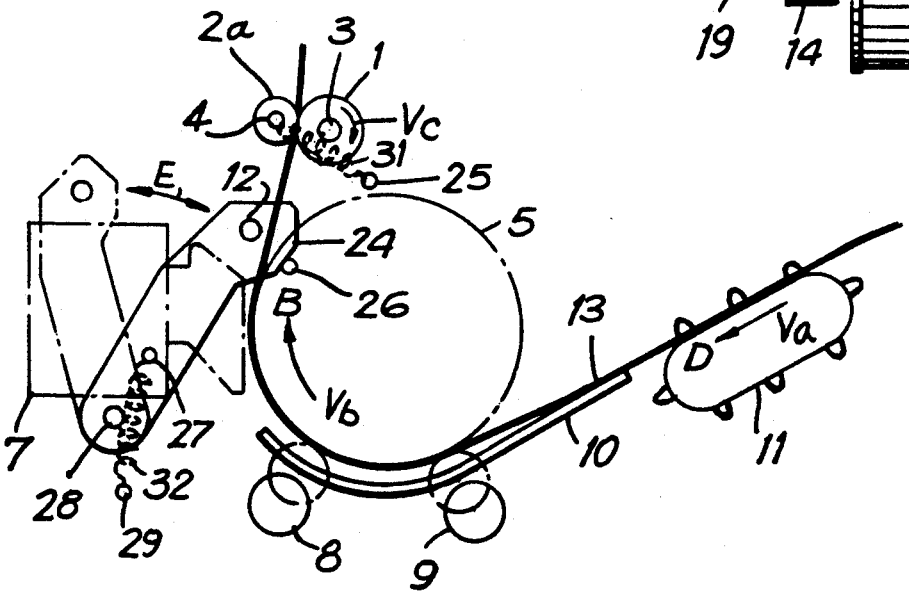
FIG. 8

FIG. 9
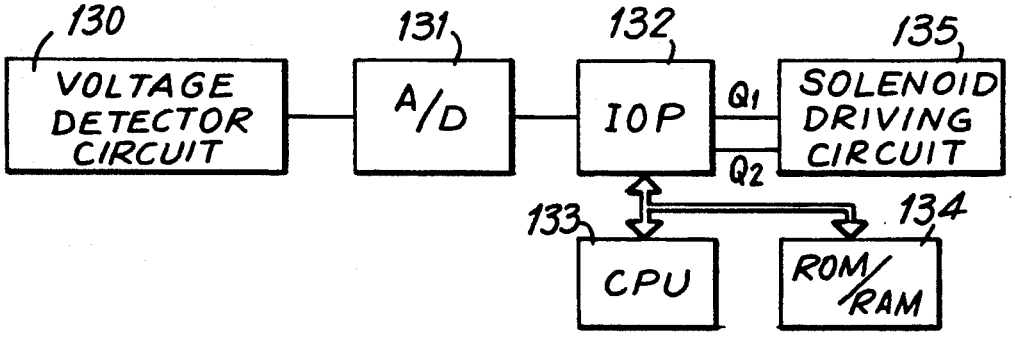
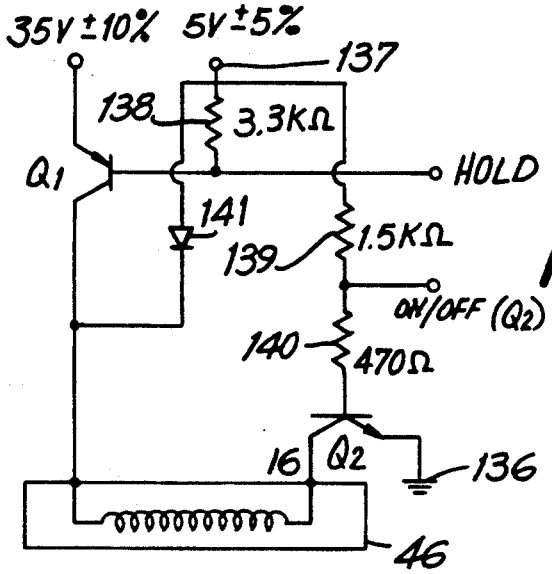
FIG. 10
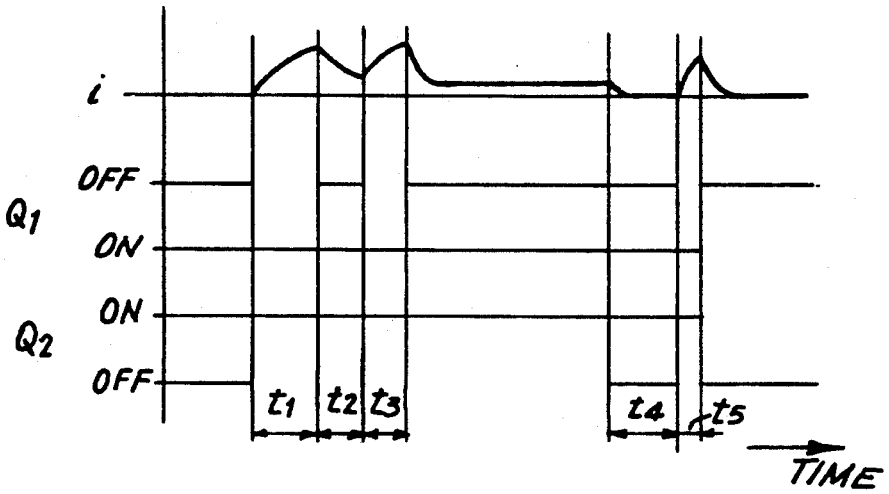
FIG. 11

FIG. 12
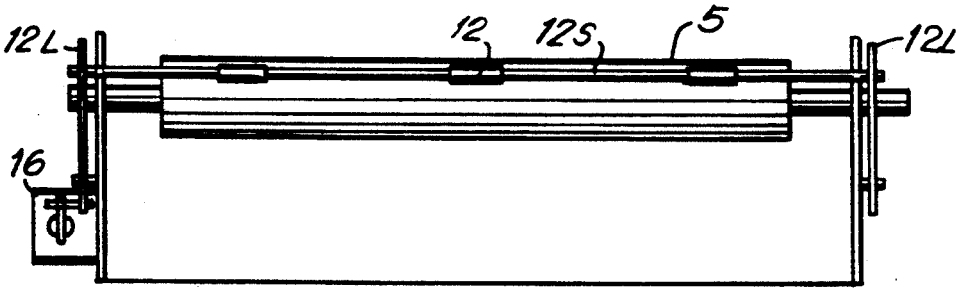
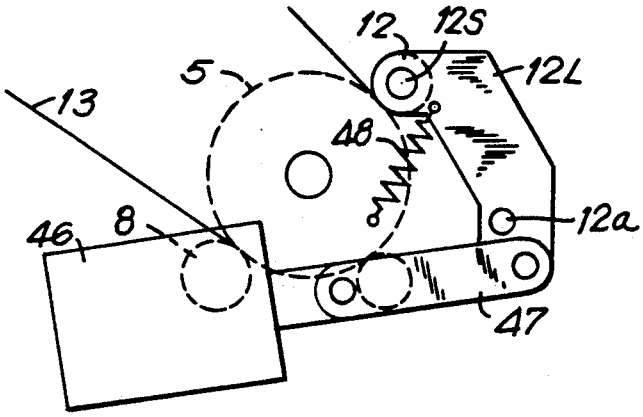
FIG. 13
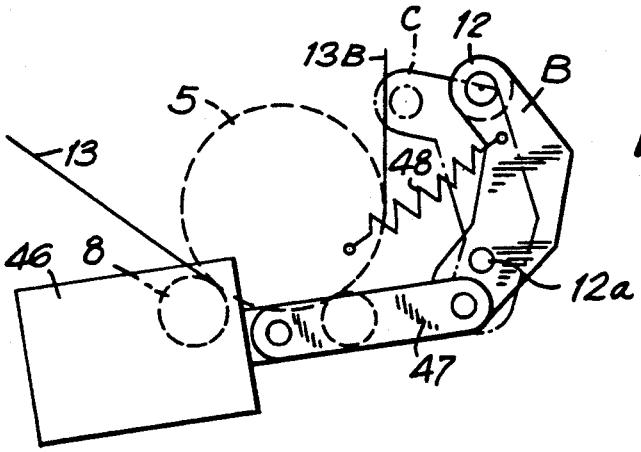
FIG. 14
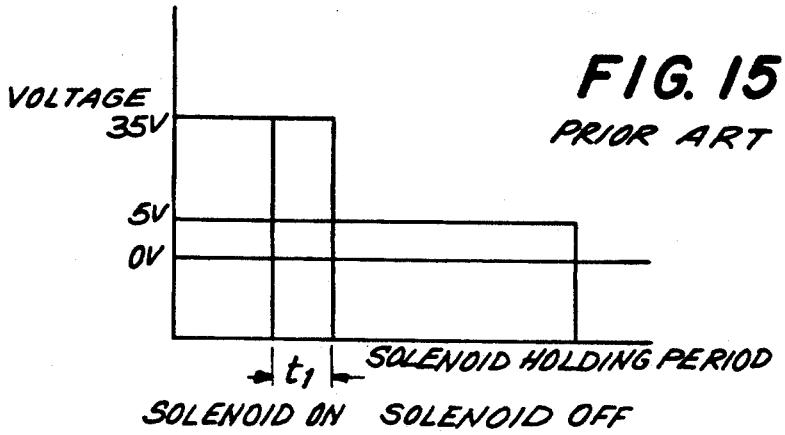
FIG. 15
PRIOR ART

APPARATUS FOR FEEDING INDIVIDUAL SHEETS OF PAPER AS WELL AS CONTINUOUS FAN FOLD PAPER UTILIZING A PLATEN

This is a continuation of application Ser. No. 07/494,998 filed on Mar. 16, 1990 now abandoned, which is a continuation of Ser. No. 07/210,440 filed Jun. 23, 1988, now abandoned.

BACKGROUND OF THE INVENTION

The present invention relates generally to a paper feeding apparatus for printers, and, in particular, to an apparatus for feeding individual sheets of paper as well as continuous fanfolded paper utilizing a platen.

Conventional printers include a platen, a roller and a printhead. The roller has a diameter smaller than the diameter of the platen and is provided at the upper portion of the printhead located at the paper feed-out position relative to the printhead and platen. The roller is pressed against the platen with the paper being positioned therebetween to generate a frictional force to cause the fed-out portion of the paper to be drawn out after printing has occurred.

The paper feed speed at both the supply side of the printer and the feeding-out region are determined by the platen diameter. Accordingly, a platen having a uniform diameter is required so that no difference is caused between the paper input speed and paper output speed. No problem arises in feeding individual sheets of paper. However, when feeding continuous rolls of paper having a line of feeding holes spaced at regular intervals therebetween along both edges, such as in computer paper, where the power for feeding is not provided by the platen but rather by a sprocket or belt having pins inserted in the feeding holes, conventional printing results in inferior print quality and feeding. A fine difference between the speed of the platen and the speed of the sprocket arises due to the differences in ambient temperature and paper sag resulting in tearing of the feed holes ad other such problems when paper feeding is repeated over a long period of time corresponding to large distances of paper. Accordingly, in the conventional printer, high position accuracy of the paper with respect to the printhead and stable paper feeding over a long period of time cannot be maintained.

Additionally, the conventional printer includes a paper bail for pressing paper against the cylindrical platen. The paper bail is driven by a solenoid to a position in which the bail is in contact with the platen as well as to a position in which the bail is released from the platen. The paper bail, when not being driven by the kinetic energy of the solenoid, is either in touch with the paper on the platen or in touch with a stopper which is at a release position and held with mechanical shocks. The bail is supported on a paper bail lever and a loading lever. Accordingly, the conventional printer produces impact noises caused by the abrasion or impinging at a junction portion of a paper bail shaft with the paper bail lever or at a junction portion of the paper bail lever with a loading lever producing rasping. Furthermore, marks caused by the paper bail are left on pressure sensitive paper as a result of the impact of the paper bail when it is returned to the press position from the paper release position. Additionally, when a mechanical dampener is attached to lighten the impact of the paper bail, the device by necessity must become complicated and overly large. The mechanical dampener may be a solenoid with a shock absorbing member positioned between the movable core and fixed core. It may also be a solenoid having a gap on the absorbing surface between the movable core and fixed core for achieving an air dampener type operation which absorbs noises when the movable core is absorbed by the fixed core. The mechanical dampener may also include a solenoid having an external shock absorbing member.

Reference is now made to FIGS. 1, 1A, 2 wherein the structure and method for inputting and feeding out paper for a conventional controlling method and printer is provided.

The conventional printer is provided with a platen 55 and a paper feeding roller 58 pressing against platen 55 for feeding a sheet of paper 13 therebetween. A printhead 7 is spaced a predetermined distance from platen 55.

In a first step 101 (FIG. 2), the power of the printer is turned on. Print paper 13 is manually inserted so that the end of paper 13 is positioned at a position wherein paper feeding roller 58 is pressed against platen 55 in accordance with a step 102 and then is adjusted so that the top end of paper 13 is at position S in accordance with a step 103.

A switch 202 for autoloading paper 13 provided on an operation panel 200 or the like is then pressed in accordance with a step 104 causing platen 55 to rotate in the direction of arrow U a predetermined distance stored in a ROM 204 to feed the paper 13 in the direction of arrow P in accordance with a step 105. The loading sequence is completed when the leading edge of paper 13 originally at position S is fed to a predetermined starting position R. The print apparatus is now in a condition for awaiting for print data.

When individual cut sheets 13 are utilized, printing sometimes starts at a position which is not predetermined, for example, within a predetermined frame or at the very upper portion of paper 13. Accordingly, in the conventional printer, it becomes necessary to determine whether additional controlling of the feed amount is required in accordance with a step 106. In the conventional process, when additional positioning is required, the user turns a knob 206 or the like attached to the platen 55 to adjust the starting position of paper 13 after the paper positioning has been set by the autoloader in correspondence with a step 107. Step 107 is repeated until proper positioning is obtained. Accordingly, printing with a conventional printer necessitates fine adjustment of the starting position which is difficult since manual turning of the platen 55 is required. Since the platen 55 must be turned manually and since the knob 206 must be turned for the printing of each new paper sheet 13, the adjustment operation is troublesome and varies between different sized sheets. The printer then waits for the printing data to be input in accordance with a step 108 and when the printing data is received, it prints on paper 13 in accordance with a step 109 until the process is completed and ended in accordance with a step 110. Thus, paper loading in accordance with the prior art is cumbersome and difficult.

Accordingly, it is desired to provide a paper feeding apparatus for a printer which overcomes the disadvantages of the prior art devices described above.

SUMMARY OF THE INVENTION

Generally speaking, in accordance with the present invention, an apparatus having an improved feeding structure is provided. A printer for feeding both individual sheets and fanfolded continuous sheets includes a rotationally mounted platen and a roller made of rubber or the like provided at the feed-out portion of the platen, corresponding to the downstream side of the printhead in the paper feeding direction. The roller rotates at a speed at least equal to the peripheral speed of the platen. Print paper fed out of the printer contacts the periphery of the roller and is drawn by the frictional force thereof.

Additionally, a paper pressure lever, such as a bail, is provided. During automatic closing of the paper pressure lever, by the returning force of the paper pressure member, a driving means is energized before the paper pressure lever is returned to a paper pressing position. The pressure lever is returned to the open position by a plurality of discrete energizations of the loading solenoid until the pressure lever is returned to the open position.

The paper is automatically positioned by autoloading based upon preset information stored in a ROM. Any remaining length necessary for positioning can be precisely controlled with a button operation to rotate the motor for driving the platen backward or forward in small steps and stored in a RAM.

Accordingly, it is an object of this invention to provide improved feeding of individual sheets as well as fanfolded sheets through a printer.

Another object of this invention is to provide a paper feeder which insures that paper is fed accurately and steadily even during ambient conditions or with varieties of paper without tearing of paper, jamming or any decrease in paper feeding accuracy caused by deflections within the paper.

Another object of the invention is to provide a paper feeder which reduces the impact between the paper pressure lever and the platen resulting from impact noise thereof, the abrasion of the paper pressure lever and the paper pressure roller shaft, thereby providing a more durable printer which also removes any trace of the paper pressure roller left on pressure sensitive paper.

Still another object of the invention is to provide a paper feeding apparatus which reduces the impact of the pressure lever during the opening movement of the pressure lever.

Yet another object of the invention is to provide a paper feeder which eliminates unstable movements such as the rebounding of the paper pressure lever caused by impact at the opening movement of the paper pressure lever produced by high voltage and the returning to the press position before reaching the release position produced by low voltage.

Yet another object of the invention is to, provide a print feeder which may be constructed without mechanical dampeners utilizing a compact paper pressure apparatus with a loading solenoid performing automatic opening and closing movements in a steady, stable and quiet manner.

Another object of this invention is to provide a printer in which any initial mispositionings which occur due to the accuracy of the parts can be corrected so that paper may be loaded precisely to an initial printing position more accurately and easily than utilizing manual adjustments.

Yet a further object of the invention is to provide a paper feeder which results in the precise autoloading of paper to a desired position.

Yet another object of the invention is to provide a paper feeder in which the user does not have to repeat the paper positioning operation for each cut sheet when repeating a printing at a specific position of a cut sheet and to prevent any discrepancies of imprint position.

Still other objects and advantages of the invention will in part be obvious and will in part be apparent from the specification and drawings.

The invention accordingly comprises an apparatus embodying features of construction, combination of elements and arrangement of parts which will be exemplified in the constructions hereinafter set forth and the scope of the invention indicated in the claims.

BRIEF DESCRIPTION OF THE DRAWINGS

For a fuller understanding of the invention, reference is had to following description taken in connection with the accompanying drawings in which:

FIG. 1A is block diagram of a portion of the paper feeding apparatus of FIG. 1 constructed in accordance with the prior art;

FIG. 3 is a front elevational view of a paper feeding apparatus in accordance with the present invention;

FIG. 4 is an enlarged sectional view of the paper feeding apparatus depicted in FIG. 3;

FIG. 5 is a front elevational view of an apparatus for feeding paper in accordance with a second embodiment of the invention;

FIG. 6 is an enlarged sectional view of the paper feed apparatus depicted in FIG. 5;

FIG. 7 is a front elevational view of a paper feeding apparatus in accordance with a third embodiment of the invention;

FIG. 8 is an enlarged sectional view of the paper feed apparatus depicted in FIG. 7;

FIG. 9 is a block diagram of a paper feed control in accordance with an embodiment of the present invention;

FIG. 10 is a circuit diagram of a driving circuit for controlling the solenoid in accordance with an embodiment of the invention;

FIG. 11 is a timing chart for the operation of the circuit of FIG. 10;

FIG. 12 is a front elevational view of a paper pressure mechanism in accordance with another embodiment of the invention;

FIG. 13 is a schematic side view of the paper pressure mechanism after paper setting in accordance with an embodiment of the invention;

FIG. 14 is a schematic side view of the paper pressure mechanism in a released condition in accordance with an embodiment of the invention;

FIG. 15 is a timing chart for energizing a solenoid in accordance with the prior art;

FIG. 19 is a block diagram of the memory adjustment structure for a paper feeding apparatus constructed in accordance with the invention.

DETAILED DESCRIPTION OF THE PREFERRED EMBODIMENTS

Figure 1:
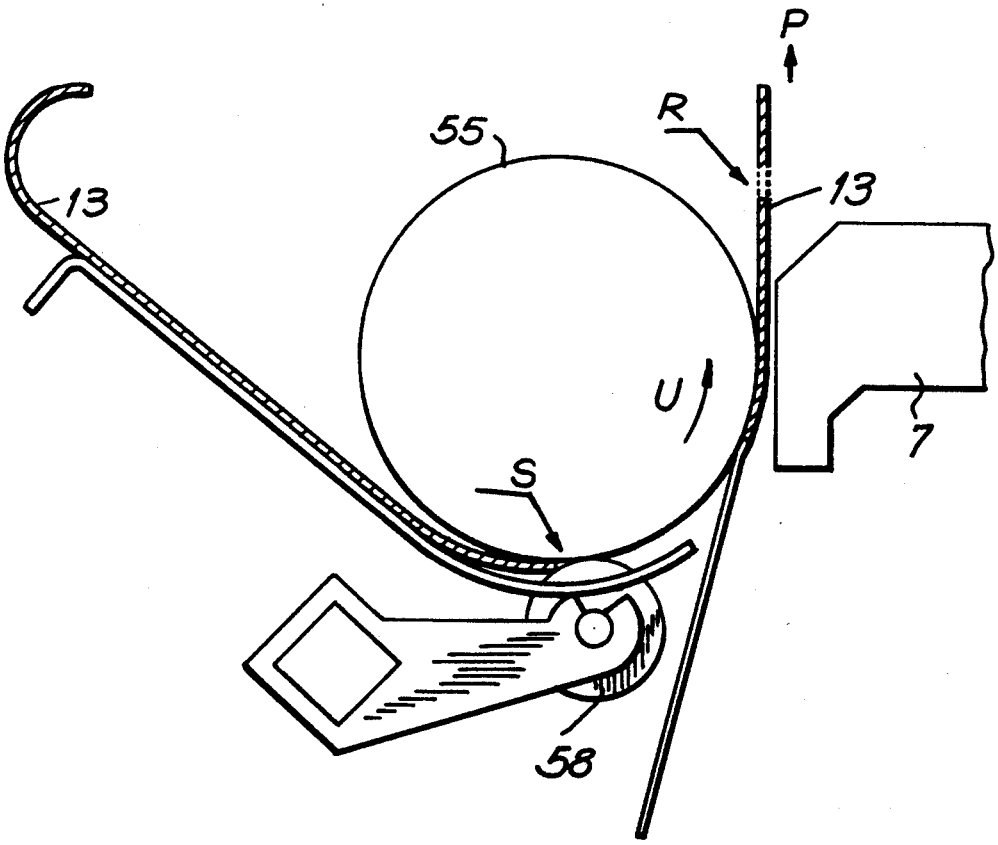
FIG. 1 PRIOR ART
FIG. 1 is a paper feeding apparatus in accordance with the prior art.
Figure 2:
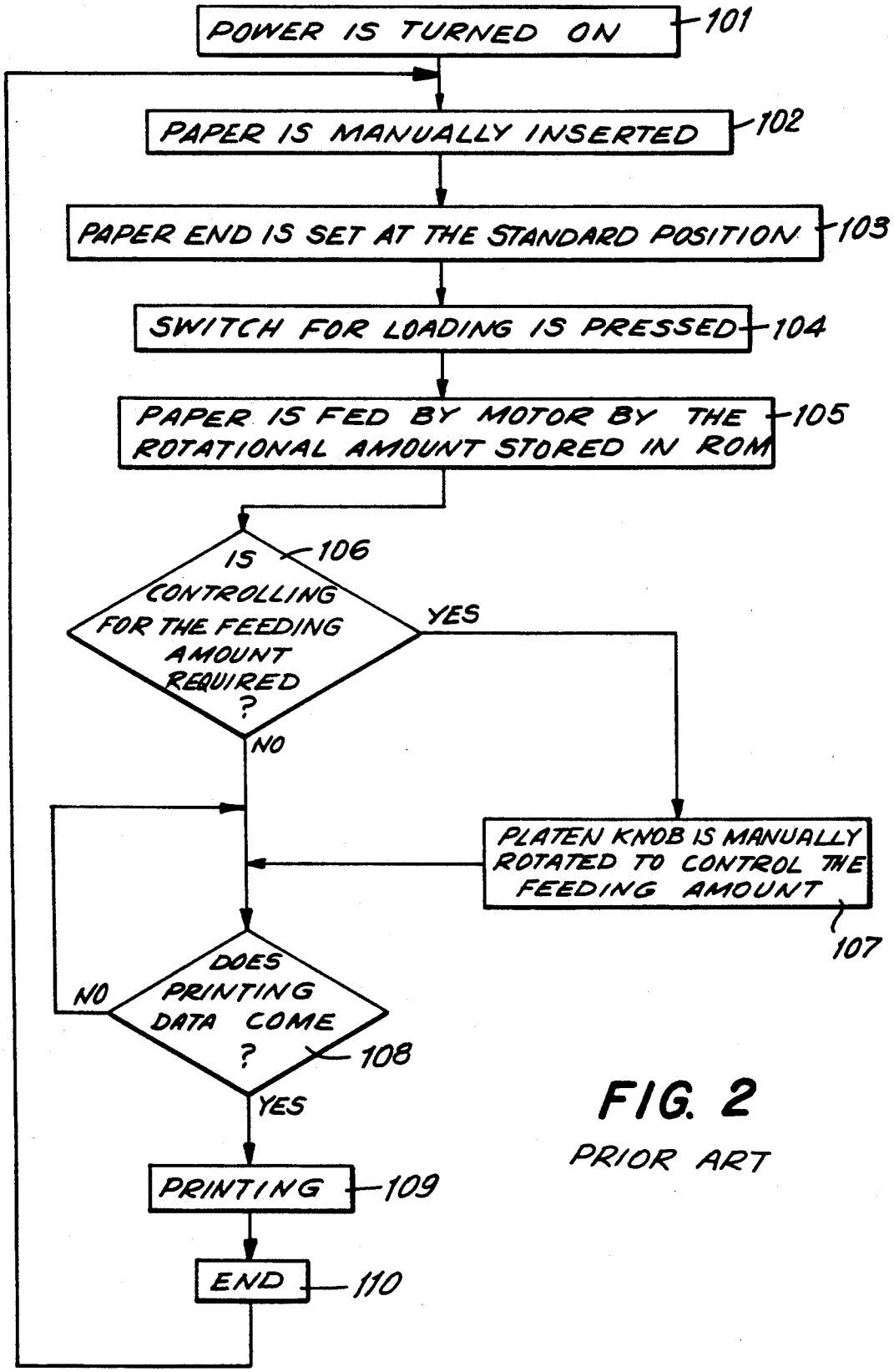
FIG. 2 PRIOR ART
FIG. 2 is a flow chart for autoloading paper in accordance with the prior art.

Reference is first made to FIGS. 3 and 4, wherein an apparatus for feeding paper in a printer, generally indicated at 100, and constructed in accordance with a first embodiment of the present invention, is depicted. Printer 100 is a serial type impact dot printer, as are each of the embodiments described below.

A platen shaft 16' is rotatably supported on a printer frame 19 and is rotatable in the direction of an arrow B. A platen 5 is supported on shaft 16'. Platen 5 is made of rubber or the like and has the requisite coefficient of friction for paper feeding and printing. A printhead 7 is spaced a predetermined distance g from platen 5 and moves longitudinally along platen 5 in reciprocating motion in the direction of arrow A. Paper 13 is fed around platen 5. Paper feeding rollers 8 and 9 are provided below platen 5 at an upstream side of platen 5 in the paper feeding direction relative to printhead 7. A paper guide plate 10 for guiding the leading edge of paper 13 towards the front of printhead 7 is supported between platen 5 and rollers 8 and 9. Guide plate 10 is disposed a predetermined distance away from platen 5 and is curve-shaped to wrap partially around the circumference of platen 5. A tractor 11 is positioned at a spaced distance from the upstream side of paper guide plate 10. Tractor 11 is formed of a continuously looped belt 11*b* having pins 11*a* projecting outwardly therefrom. Pins 11*a* have the same diameter and pitch as the feeding holes 13*a* of the fanfold paper 13.

A paper bail 12 is disposed at the paper feed out side of platen roller 5, downstream in the paper feed direction relative to printhead 7. Paper bail 12 is movable in the direction of arrow E. A shaft 3 is rotatably mounted on frame 19 and supports several paper feed out rollers 1 in the paper feed-out region above printhead 7 and platen 5. A shaft 4 is mounted on frame 19 and supports a plurality of auxiliary rollers 2. Auxiliary rollers 2 and paper feed-out rollers 1 are disposed in the paper feed-out region at a distance above printhead 7 and platen 5. When bail 12 moves from a first position shown in phantom as bail 12' to a second position shown in solid line, it acts to guide the leading edge of print paper 13 in the gap between feed-out rollers 1 and auxiliary rollers 2 and printhead 7.

Each paper feed-out roller 1 has a coefficient of friction equal to that of rubber or similar materials and is driven in the direction of arrow C to draw out print paper 13. As depicted in FIG. 4, the outer diameter of auxiliary roller 2 overlaps feed-out roller 1 by a distance h. Additionally, each auxiliary roller 2 is spaced by a distance i from each adjacent feed-out roller 1 at each side of feed out roller 1. Feed-out rollers 1 are fixed to shaft 3 by tension fit or the like to prevent idle running, so that paper feed-out rollers 1 rotate only with the rotation of shaft 3. Auxiliary rollers 2 are rotatably mounted on shaft 4 so that a friction load with respect to the movement of paper 13 is not caused at the contact portion of feed-out roller 1 with print paper 13 allowing auxiliary rollers 2 to perform idle running.

Feed-out roller shaft 3 and platen shaft 16' both pass through and engage frame 19 and are positioned to rotate smoothly. A feed-out roller gear 18 is affixed to the end portion of shaft 3 which projects beyond frame 19. Similarly, a platen gear 16 is affixed to the portion of shaft 16' which projects beyond frame 19. A shaft 17' projecting from frame 19 supports a transmission gear 17. Transmission gear 17 engages feed-out roller gear 18 and platen gear 16. A shaft 15' extends from frame 19. A reduction gear 15 and a gear 15*a* are supported on shaft 15'. Gear 15*a* engages gear 16. A paper feeding motor 6 is coupled to a drive gear 14 which engages reduction gear 15, forming a gear train which causes platen 5 and paper feed-out rollers 1 to rotate.

During cut sheet printing, tractor 11 is not utilized and print paper 13 as shown in phantom (FIG. 4) is directly inserted between paper guide plate 10 and platen 5. Each cut sheet 13 is pressed against platen 5 with a high load force by paper feeding rollers 8 and 9 as positioned in the broken line depiction. The cut sheet 13 is positioned and moved in accordance with the rotation of the peripheral surface of platen 5 by frictional forces resulting from the circumference of platen 5 acting upon each cut sheet. Accordingly, since print paper is fed by the peripheral surface of platen 5, which corresponds to the actual print area, the positional accuracy with respect to printing is high.

During the printing of fanfold paper 13, paper feeding rollers 8, 9 are separated from platen 5 and positioned as indicated at 8' and 9'. Print paper 13 is captured by pins 11*a* of tractor 11 and is inserted in direction of arrow D into the space between guide plate 10 and the periphery of platen 5. At the upper portion of platen 5, corresponding to the downstream side of the paper feed direction with respect to printhead 7, both cut sheet and fanfold paper 13 are fed toward paper bail 12 while wrapping around the periphery of platen 5 past the front of printhead 7. Paper bail 12 is located at the position 12' indicated by the broken lines, until the leading edge of paper 13 is fed to approximately the intermediate point between paper bail 12 and feed-out roller 1. By delaying the movement of paper bail 12, the leading edge of paper 13 is fed to a position higher than printhead 7, preventing premature contact with paper bail 12, thus, preventing jamming. When the leading edge of paper 13 reaches the intermediate point, paper bail 12 moves in the direction of arrow E to the position indicated by solid lines to guide the leading edge of paper 13 to cause it to automatically enter the opening between feed-out rollers 1 and auxiliary rollers 2.

Paper feed motor 6 provides rotational force for powering the paper feeding process. Drive gear 14 affixed to the tip portion of motor shaft 6' is rotated by the rotation of motor 6. The rotational power of motor 6 is transmitted to platen gear 16 supported on shaft 16' through reduction gear 15 causing platen 5 to rotate. Further, platen gear 16 causes feed-out roller gear 18 to rotate through transmission gear 17 causing the plurality of feed rollers 1 fixed in the column direction to rotate.

The outer diameter of platen 5 is approximately the same as the diameter of the pitch circle of platen gear 16. The outer diameter of feed-out roller 1 is the same as or slightly greater than the diameter of the pitch circle of feed-out roller gear 18. Accordingly, a peripheral speed Vc of feed roller 1 is greater than or equal to the peripheral speed Vb of the platen 5 by a factor of more than 1. Additionally, tractor 11 is arranged so that the peripheral speed Va of tractor 11 and the peripheral speed Vb of platen 5 is such that $Vb \geqq Va$. By setting the downstream feeding speed greater than or equal to the upstream feeding speed, the paper 13 does not sag between each of the paper feeding elements 11, 5, 1.

At the feed-out portion, feed-out rollers 1 and auxiliary rollers 2 are arranged so that they overlap with each other by a distance h and are arranged with a gap i therebetween. Therefore, paper 13 inserted between feed-out roller 1 and auxiliary feed-out roller 2 is caused to sag in the column direction and is pressed against each roller 1 and 2 by the restoring force of the paper 13. Paper 13 is fed out by the frictional force generated between paper 13 and rollers 1 and 2 in accordance with rotation of rollers 1 and 2. The restoring force of paper 13 varies in accordance with the paper 13, so that thicker paper 13 has a stronger restoring force. Accordingly, thick paper 13 is likely to generate sagging by curvature along the paper path between tractor 11 and feed-out roller 1. This sagging is prevented by a stronger feed-out force. On the other hand, for thin paper 13 having a small restorative force which is easily torn when strong stress is concentrated on the pins of tractor 11 due to too large a tensile force, the tensile force is reduced to prevent this tearing of feeding holes 13*a*. In such a manner, the feed-out force is automatically self-controlled in accordance with the thickness of the paper 13.

The feed force generated by platen 5 provided at an intermediate position in paper feed apparatus 100 does arise from pressing paper bail 12 directly against platen 5 to sandwich the paper 13 therebetween. Paper bail 12 only guides the paper 13 which is separated from platen 5, so that it depends on the contact angle of paper 13 with respect to platen 5 and the feed-out force generated by feed-out roller 1. Therefore, the feed-in force is directly related to the feed-out force and is self-controlled in accordance with the thickness of the paper 13. Furthermore, if the amount of sagging, tear or friction coefficient of feed-out roller 1 and that of platen 5 are changed due to the change in ambient temperature or ambient humidity, a corresponding change in paper rigidity is caused whereby the feed-out force from feed-out roller 1 and the feed-in force from platen 5 are changed. For example, even when the friction coefficient is decreased at low ambient temperature and paper 13 sags less easily, the feed-out force is increased with a rise of paper rigidity to prevent sagging. Additionally, if the frictional coefficient is increased at high ambient temperature and paper 13 is made to sag more easily, the feed-out force is decreased with a lowering of paper rigidity to prevent tearing of the paper 13.

Reference is now made to FIGS. 5 and 6 in which a second embodiment of the paper feeding apparatus, generally indicated at 200, similar to apparatus 100, is depicted. In the second embodiment, like parts are indicated with like numerals. A principal difference between paper feeding apparatus 200 and paper feeding apparatus 100 is replacement of auxiliary rollers 2 and paper bail 12 by guide cover 20 which is integrally constructed of transparent resin. Additionally, tractor 11 has been replaced by sprocket wheel 22 having pins 22*a* and guide plate 23.

Paper guide cover 20 includes a sheet forming plate portion 20*b* and a rib portion 20*a* integrally formed on plate portion 20*b* extending in the column direction. Paper 13 is guided by the ridge line portion 20C of rib portion 20*a*. Paper guide cover 20 extends along frame 19 and both ends of paper guide cover 20 are affixed to frame 19 by screws 21.

Sprocket wheel 22 engages feeding holes 13*a* of paper 13. A sprocket wheel cover 23 is provided to prevent paper 13 from rising from sprocket wheel 22.

The operation and overall effect of paper feed apparatus 200 is almost the same as that of paper feed apparatus 100. The leading edge of paper 13 is guided past printhead 7 to feed-out roller 1 along rib portion 20*a* of paper guide cover 20. The guiding function of guide plate cover 20 replaces the opening/closing movement of paper bail 12. Also, in paper feed apparatus 200, rib portion 20*a* of paper guide cover 20 is arranged on both sides of feed-out roller 1 at a distance i from roller 1 and is overlapped by roller 1 by an amount h, so that the construction produces the feed-out force due to paper sagging in the column direction in a manner similar to that of auxiliary rollers 2 in paper feed apparatus 100. Tractor 11 may be substituted for sprocket 22 in paper feed apparatus 200.

Reference is now made to FIGS. 7 and 8 in which a third embodiment of a paper feed device, generally indicated at 300, similar to apparatus 100 is depicted. Again, like numerals are utilized for depicting like elements.

An auxiliary feed-out roller 2*a* is disposed so as to directly contact feed-out roller 1 rather than being positioned at either side of feed-out roller 1 of paper feed apparatus 100.

A feed-out roller frame 30 supports gears 17 and 18 and shafts 3 and 4. The pressing load between auxiliary roller 2*a* and paper feed-out roller 1 is supplied by a spring 31 anchored at one end to a spring peg 25 projecting from frame 30 and to shaft 4 at its other end. Spring 31 biases auxiliary roller 2*a* towards paper feed-out roller shaft 3. Shaft 3, feed-out roller gear 18, transmission gear 17 and frame 30 form a removable unit which is detachable from frame 19.

A shaft 28 projects from frame 19. A paper bail lever 24 is pivotably mounted on shaft 28 and supports paper bail 12 so that paper bail 12 is pivotable in the direction of arrow E. A shaft 29 projects from frame 19. A second shaft 27 projects from paper bail lever 24. A spring 32 anchored at shafts 27 and 29 biases bail lever 24 towards platen 5. A stopper pin 26 projecting from frame 30 in the path of bail lever 24 prevents bail lever 24 from rotating past stop 26. Paper bail 12 rises up from platen 5 as shown in FIG. 8 to a release position. When frame 30 is separated from frame 19, stopper 26 is also removed so that paper bail 12 is utilized as a conventional printer, wherein paper bail 12 is pressed against the periphery of platen 5 by tension spring 31 and another unit such as a cut sheet feeder may be mounted.

In paper feeding apparatus 300, auxiliary feed-out roller 2*a* is biased against feed-out roller 1 sandwiching print paper 13 therebetween by tension spring 31 so that the feed-out force for print paper 13 is determined by the load of tension spring 31 and the surface friction coefficient of feed-out roller 1, rather than the restoring force produced by the paper sag of the above-described embodiments.

Reference is now made to FIG. 9 wherein a block diagram for the controlling of the operation of paper bail 12 is depicted. A voltage detector 130 provides an input to an analog to digital conversion circuit (A/D) 131. An input/output (IOP) 132 receives the output of A/D circuit 131. The output of IOP 132 is coupled to the base of a first transistor $Q_1$ and a second transistor $Q_2$ of a solenoid driving circuit 135. IOP 132 provides an input to a microprocessor (CPU) 133 and to a ROM/RAM 134.

A change in voltage from an expected value of 35 volts is detected by voltage detector circuit 130 and is converted into a digital signal by A/D circuit 131. The digital signal is input into IOP 132. CPU 133 detects the condition of IOP 132 and changes the attraction time period generated by solenoid driving circuit 135 for loading solenoid 46 (FIG. 10) in accordance with the output of CPU 133 corresponding to that condition and turns on transistor $Q_1$. In such a manner, the driving time of transistors $Q_1$ and $Q_2$ is set in accordance with the combination of the level of the output line of A/D circuit 131 and the counted value corresponding to the time is stored in ROM/RAM 134 and is read out by CPU 133 allowing for the proper control of transistors $Q_1$ and $Q_2$.

Reference is now made to FIG. 10 in which solenoid driving circuit 135 is depicted in greater detail. A solenoid 46 receives an input from the collector of NPN transistor $Q_1$ and the collector of PNP transistor $Q_2$. A voltage input is provided at the emitter of $Q_1$. The emitter of transistor $Q_2$ is connected to a ground 136. A second voltage input 137 is input through a first resistor 138 having a value of 3.3K Ω which is coupled to a HOLD output and the base of transistor $Q_1$. At input 137, resistor 138 is connected with a second resistor 139 having a value of 1.5K Ω and a third resistor 140 having a value of 470 Ω. Resistors 139 and 140 are serially connected to the base of transistor $Q_2$. A diode 141 is connected between input 137 and the collector of transistor $Q_1$.

A voltage of 35 volts is applied to loading solenoid 46 by turning on transistors $Q_1$ and $Q_2$. Additionally, a voltage of 5 volts is applied to loading solenoid 46 by turning off transistor $Q_1$ and turning on transistor $Q_2$.

Reference is now made to FIGS. 11 through 14 wherein the operation of solenoid 46 and a bail lever 12L will be explained.

Loading solenoid 46 is operatively coupled to a loading lever 47. A paper bail lever 12L having a fulcrum point 12*a* in the center is rotatably mounted on loading lever 47. A shaft 12S is supported on either side of the printer by paper bail levers 12L. Bail 12 is rotatably supported by shaft 12S and is mounted in parallel to platen 5. Paper bail 12 is brought into contact with platen 5 through paper bail lever 12L by a paper bail pressure spring 48 attached on both sides of the printer so as to be anchored on each bail lever 12L on either end of paper bail 12. When print paper 13 is to be automatically loaded, after loading the leading edge of paper 13 to the point where paper feed roller 8 contacts platen 5, loading solenoid 46 is energized by simultaneously turning on transistors $Q_1$ and $Q_2$ causing loading lever 47 to move bail lever 12L to an open position at an intermediate position C, before paper bail lever 12L reaches the fully open position. Both transistors $Q_1$ and $Q_2$ are turned on for a period $t_1$. Transistor $Q_1$ is then turned off for a period of time $t_2$. Transistor $Q_1$ is then turned back on. As described above, unstable movement of paper bail lever 12L arising from a change in driving voltage may be corrected by properly setting energizing period $t_1$ in accordance with the changes in driving voltage and thus, the impact of paper bail lever 12L reaching release position C' can be reduced.

After paper bail lever 12L reaches release position C', transistor $Q_1$ is turned off to maintain paper bail lever 12L in a standby mode in the release condition at position C'. Because of the above controlling of the movement of bail lever 12L, the attraction force of loading solenoid 46 is released halfway and the energy is absorbed by a tensile force of paper bail pressure lever spring 48 in a direction opposite to the inertial force around shaft 12S. Therefore, speed of, movement of paper bail 12 in its movement towards release position C' may be reduced.

Platen 5 is rotated to feed the leading edge of print paper 13. When print paper 13 reaches a position 13B, the rotation of platen 5 is stopped and transistor $Q_2$ is turned off. Paper bail lever 12L is returned to a pressing position (FIG. 13) by the restoring force of paper bail pressure lever spring 48 pressing paper 13 between bail 12 and platen 5. After a period $t_4$ from the turning off of transistor $Q_2$, paper bail lever 12L reaches an intermediate position C and transistors $Q_1$ and $Q_2$ are turned on so that loading solenoid 46 is attracted for a small period of time. After a period of time $t_5$, transistors $Q_1$ and $Q_2$ are turned off and paper bail lever 12L is returned to the pressing position so that the paper 13 is completely set.

When loading solenoid 46 is energized before paper bail lever 12L is returned to the pressing position, the attraction force of loading solenoid 46 acts in the opposite direction of the restoring force of paper bail pressure spring 48 which is causing paper bail lever 12L to return. Accordingly, the speed at which paper bail 12 strikes upon platen 5 can be controlled reducing the return speed of the spring controlled lever 12L by energizing the solenoid 46 for minute time periods to apply the force in an opposite direction, thus preventing the rebounding which occurs from high speed striking of bail 12 upon platen 5.

It should be noted that loading solenoid 46 is energized only once in the operation of this embodiment, however, the same effect can be achieved by two or more switchings on and off. Additionally, the period of time is varied in accordance with the variation of the driving voltage used in this embodiment. However, if the period of time $t_2$ is varied so as to shorten the period when the driving voltage is low and prolong the period when the driving voltage is high, the same effect may be obtained.

FIG. 15 is a timing chart showing the manner of energizing a conventional solenoid.

Figure 16:
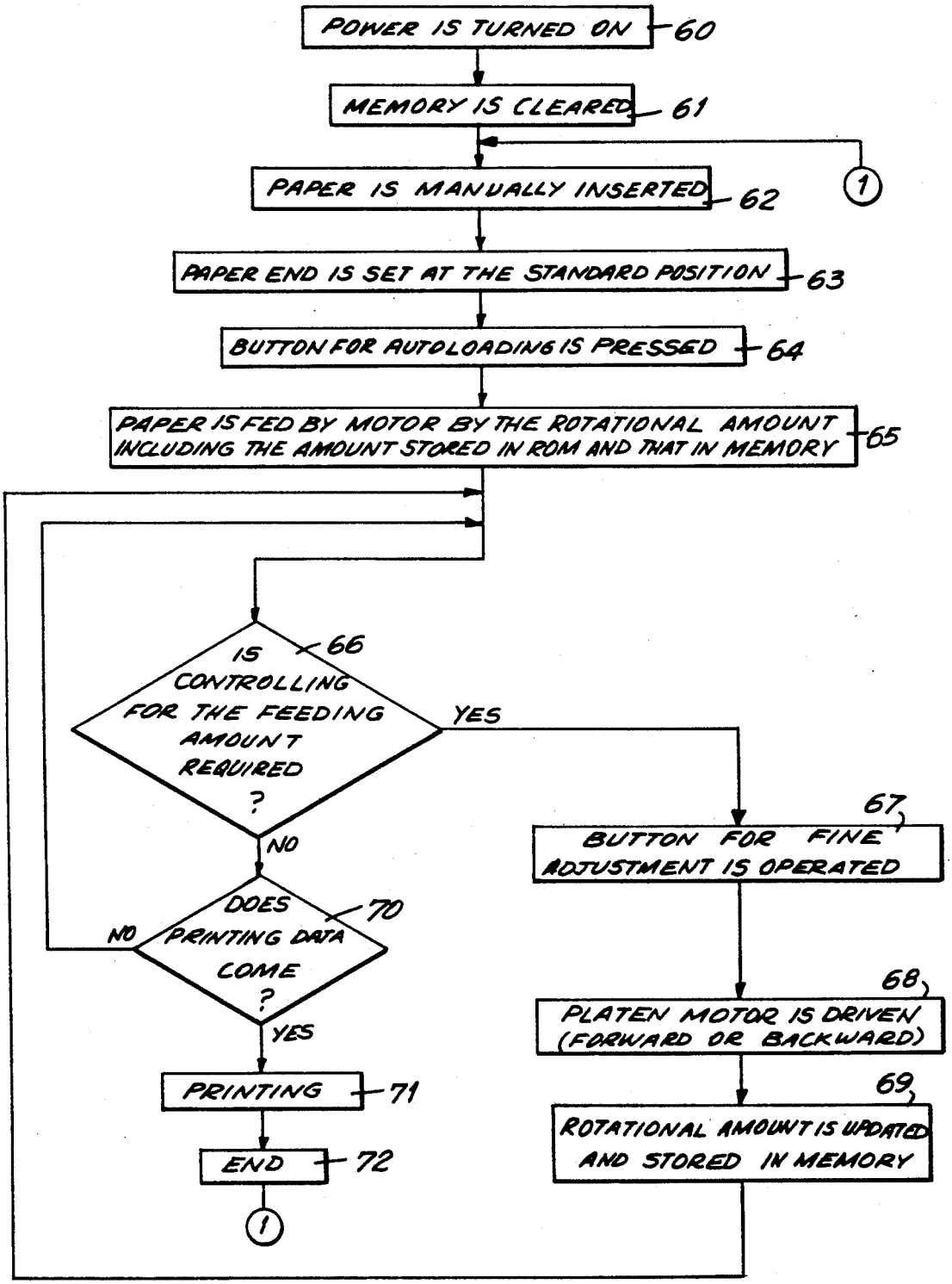
FIG. 16 is a flow chart for operating the paper feeding apparatus in accordance with an embodiment of the invention.
Figure 17:
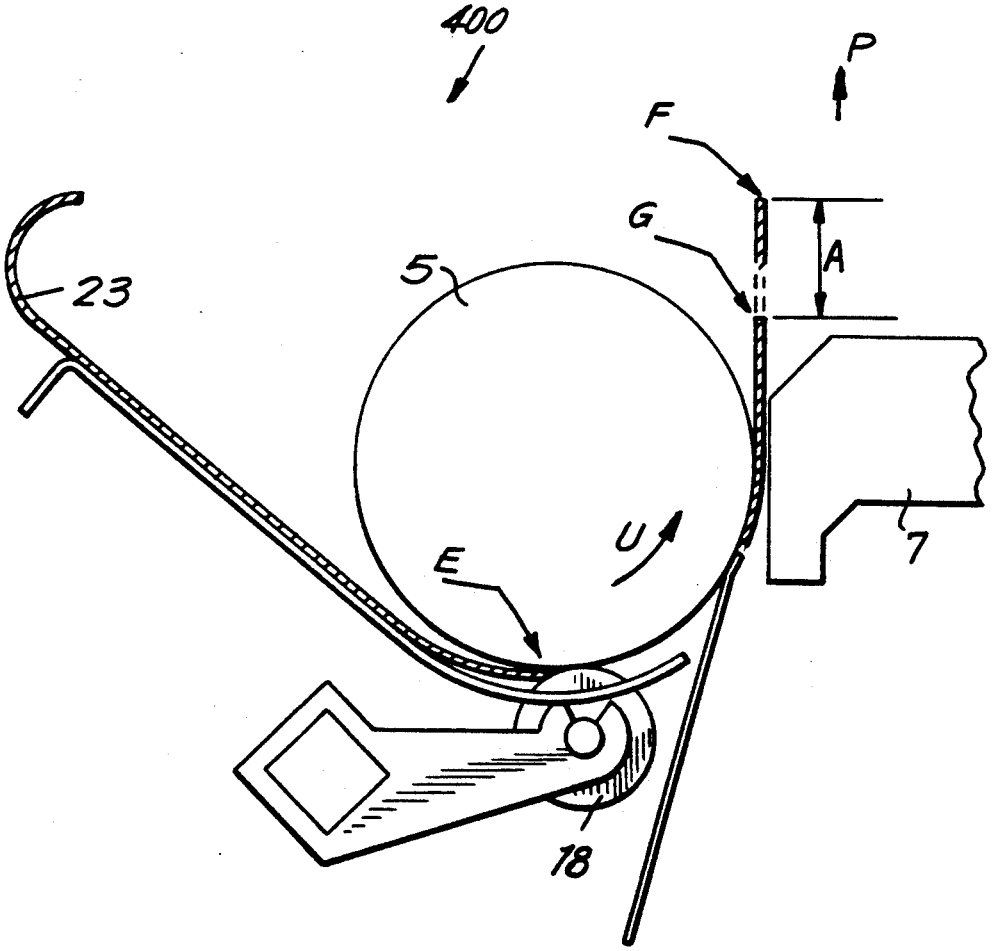
FIG. 17 is a sectional view of a paper feeding apparatus constructed in accordance with another embodiment of the present invention.

Reference is now made to FIGS. 16 and 17. FIG. 17 is a cross-sectional view of a print feed apparatus, generally indicated at 400, in accordance with another embodiment of the invention. Like numbers are utilized for like parts of the previous embodiments. The principal difference is that paper feed apparatus 400 is directed to a cut sheet printer.

A roller 81 is provided below platen 5 in the downstream direction of paper feeding with respect to printhead 7. Roller 81 presses against platen 5.

The power is turned on in accordance with a step 60, the memory including a ROM 207 and RAM 208 coupled by a BUS 214, of paper feed apparatus 400 is then cleared in accordance with a step 61. When print paper 23 is manually inserted in accordance with a step 62, the end of print paper 23 abuts a position wherein paper feed roller 18, is pressed against platen 5. Paper 23 is then adjusted to be located at a position E in accordance with a step 63. A button 211 for autoloading paper 23 provided on an operation panel, such as operation panel 200 or the like is turned on in accordance with a step 64. Paper feed motor 6 (FIG. 3) is driven by a rotational amount equal to an amount stored in the ROM 207 and in the memory 207, 208 in accordance with a step 65. The driving force of paper feed motor 6 is transmitted to platen 5 through transmission gears 14–18 to rotate platen 5 in the direction of arrow U so that the end of paper 23 at position L is fed to a position G to complete paper positioning to allow the beginning of printing. Paper feed apparatus 400 is now in a condition awaiting printing data.

Because the memory 207, 208 is in the clear condition immediately after power is applied, during the first loading the motor 6 is driven by a rotational amount stored merely in the ROM 207. However, it must be decided whether additional adjusting of the position of paper 23 is required in accordance with a step 66. If a positional change for the end of paper 23 is required, paper feeding motor 6 is rotated forward or backward small step by small step utilizing a button 212 for fine adjustment provided on the operation panel 200 or the like in accordance with a step 67 to place paper 23 in a condition for awaiting the print data.

Platen 5 is driven by drive motor 6 through a gear train 14–18 as described above in the directions of arrow U or in the opposite direction thereto in accordance with a step 68. Because the paper 23 located at position G is fed by a very small amount in the direction of arrow P or in the opposite direction thereto, a user can position the paper 23 at a desired position such as F easily and correctly without manual operation such as rotating the platen knob. This fine adjustment operation can be continued until the input of the next printing data. The rotational amount required for this fine adjustment is added to or subtracted from the memory, RAM 208, and is stored therein in accordance with a step 69. Once no more controlling or feeding is required, whether printing data is coming is ascertained in accordance with a step 70. When data arrives, printing begins in accordance with a step 71 until ended in accordance with a step 72 in which a new sheet of paper 23 is inserted and the entire process is begun again.

In the above described example, the paper 23 beginning at position G must be placed in a position F, a motor rotational amount corresponding to a length Q is stored in the memory, ROM 207,. The above sequence is completed when the printing, data is input in accordance with step 71 and goes to 1 in the flow chart after printing.

During the second autoloading of paper 23, when the switch for autoloading is turned on in accordance with step 64, paper feed motor 6 is driven by a rotational amount stored in the ROM 207 in accordance with step 65 to feed the paper to position G and the amount stored in the memory, RAM 208 corresponding to length Q so that the paper 23 is immediately fed to position F. Accordingly, it becomes unnecessary to position each paper 23 for starting each printing which remarkably improves facility of the apparatus 400. Additionally, if many papers 23 are printed, each paper 23 may be set at the correct position without variation of the printing position.

In this embodiment, the memory 134 is in a clear condition when the power of the printer is turned off. However, if the memory 134 is backed up, the starting position is retained from the last printing so that the print start position can be maintained once the power source has been turned off. Accordingly, a printing apparatus 400 becomes convenient for printing many sheets of paper 23 using a specific format.

Figure 18:
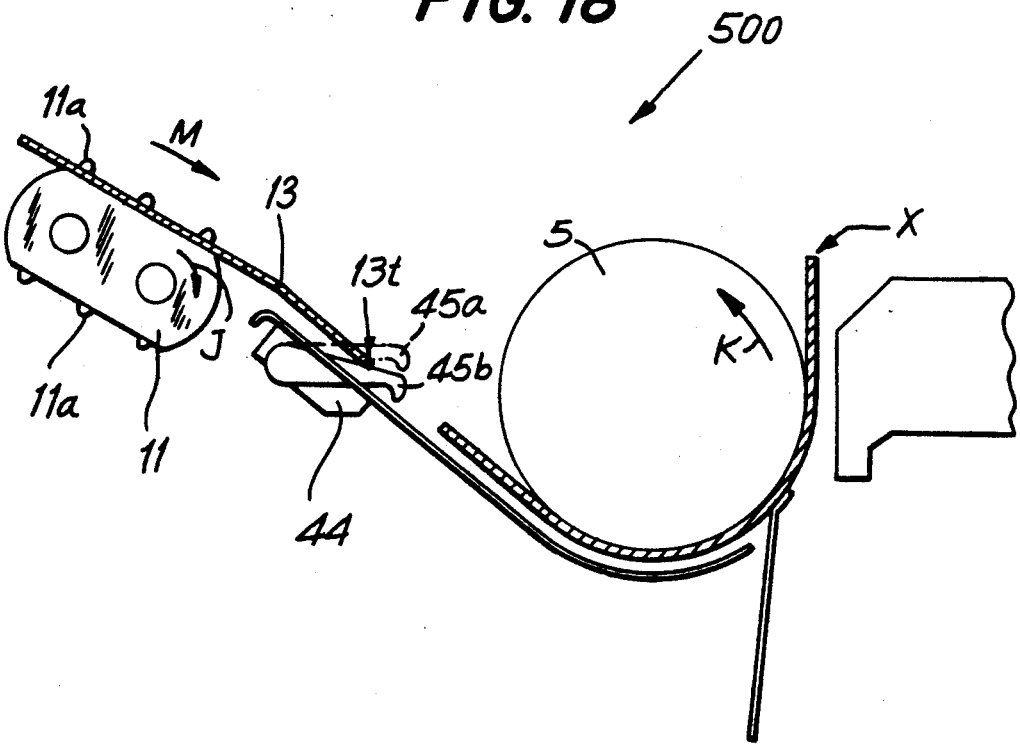
FIG. 18 is a sectional view of a printer constructed in with yet another embodiment of the present invention.

Reference is now made to FIG. 18 in which a print feed apparatus, generally indicated at 500, for printing fanfold paper 13 is provided. A paper detecting sensor 44 is disposed between tractor 11 and platen 5 in the pathway of paper 13. Fanfold paper. 13 is fed by a tractor 11 having pins 11*a* extending through holes in fanfold paper 13. Tractor 11 and platen 5 are driven by a single motor 6 through a gear train 14–18 (FIG. 3). When a switch for autoloading is turned on, tractor 11 is driven in the direction of arrow J and platen 5 is driven in the direction of arrow K to cause print paper 13 to be fed in the direction of arrow M. The end of paper 13 presses paper detecting sensor 44 downward from an initial position 45*a* to a second position 45*b*. When this occurs, the end of print paper 13 is at a position 13*t* corresponding to position E in FIG. 17 and serves as the reference position for leading the paper 13 to the desired starting position.

After detection of paper 13 by paper detector sensor 44, the motor 6 is driven in rotational amounts stored in the ROM 134 and an additional amount stored in the memory 134 to position the paper 13 in a position to begin printing. The fine adjustment operation is carried out in the same manner as in paper feeder 400. The reference position 13*t* to begin printing may vary with the accuracy of the parts of paper detector sensor 44 and mounting accuracy of paper detector sensor 44, quality of print paper 13 and ambient temperature as in the conventional method making print start position X unstable. However, in accordance with the present invention, the user can reposition the print start position X by fine adjustment, so that printing can always be started from a desired position and not be influenced by such variations.

By providing a paper feeding apparatus for a printer having a cylindrical platen rotatably supported on the frame of the printer, a paper feeder at the upstream side of the platen and a roller located at the downstream side of the platen, the roller, paper feeder and platen all being driven by a single drive means and a pressing bar for pressing fanfold paper fed out from a platen to the roller so that friction applied by the roller draws out the paper from the printer, a print feeder providing improved feeding of individual sheets as well as fanfold sheets is provided. The printer in accordance with the above description provides a paper feeder which insures accurate and steady paper feeding during ambient conditions utilizing a variety of papers without tearing of the paper, jamming of paper or any decrease in paper feeding accuracy. By controlling the motion of the press bar through a driving means which is energized before the press bar is returned to the paper pressing position the impact between the paper pressure lever and the paper is reduced.

It will thus be seen that the objects set forth above, among those made apparent from the preceding description are efficiently attained and, since certain changes may be made in the construction set forth, without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A paper feeding apparatus for a printer utilizing fanfold paper having holes along the edges thereof comprising a frame, a cylindrical platen having an upstream side and a downstream side rotatably supported on said frame, paper feeding means for feeding paper towards said platen, said paper feeding means being supported at the upstream side of the platen, driving means for driving the platen, roller means located at the downstream side of the platen, said roller means being coupled to the driving means to rotate with a circumferential speed greater than or equal to the circumferential speed of the platen, and pressing means for pressing the fanfold paper fed out from the upstream side of the platen to the roller means after printing, the roller means including at least one paper feed-out roller and a guide cover plate having a plurality of ribs extending therefrom, the ribs being adjacent the paper feed-out roller with each rib being separated at its side from the paper feed-out roller by a predetermined distance and each rib overlapping the paper feed-out roller by a predetermined distance whereby friction applied by the roller means draws out the paper from the printer.

2. The paper feeding apparatus of claim 1, wherein the paper feeding means includes a tractor, said tractor having pins extending therefrom for engaging the holes of the fanfold paper.

3. The paper feeding apparatus of claim 1, wherein the paper feeding means includes a sprocket, the sprocket having pins extending therefrom for engaging the holes of the fanfold paper.

4. The paper feeding apparatus of claim 1, further comprising autoloading means for automatically setting the paper at a predetermined loading position for printing having a first storage means for storing data representative of the predetermined loading position, a switch operable for fine adjustment of the loading position causing the paper to be moved in either of two adjustment directions, and a second storage means for storing data representative of the amount of fine adjustment performed by the switch.

5. A paper feeding apparatus for a printer utilizing cut sheet paper comprising a frame, a cylindrical platen having an upstream side and a downstream side rotatably supported on said frame, driving means for driving the platen, roller means located at the downstream side of the platen, said roller means being coupled to the driving means to rotate with a circumferential speed greater than or equal to the circumferential speed of the platen, said roller means including at least one paper feed-out roller and a guide cover plate having a plurality of ribs extending therefrom, the ribs being adjacent the paper feed-out roller with each rib being separated at its side from the paper feed-out roller by a predetermined distance and each rib overlapping the paper feed-out roller by a predetermined distance, and pressing means for pressing the cut sheet fed from the upstream side of the platen to the roller means after printing has occurred, whereby friction applied by the roller means draws out the paper from the printer.

6. The paper feeding apparatus of claim 5, further comprising autoloading means for automatically setting the paper at a predetermined loading position for printing having a first storage means for storing data representative of the predetermined loading position, a switch operable for fine adjustment of the loading position causing the paper to be moved in either of two adjustment directions, and a second storage means for storing data representative of the amount of fine adjustment performed by the switch.

7. The paper feeding apparatus of claim 5, further comprising biasing means for biasing the pressing means to a first paper pressing position, second driving means for supplying a driving force to move said pressing means to a second position, and control means for controlling the second driving means by performing one of a plurality of energizations between the second position and the first position while the pressing means is moving between said second position and said first position wherein the pressing means is returned from said second position to said first position, and controlling energization of the second driving means when the pressing means is released from the first position and is traveling to said second position.

8. The paper feeding apparatus of claim 5, further comprising a first storage means for storing data representative of a predetermined loading position, a switch for fine adjustment of the loading position in either of two paper feed directions, and a second storage means for storing data representative of the amount of adjustment accomplished by operation of the switch.

9. The controlling apparatus of claim 8, wherein said first storage means is provided in a ROM and said second storage means is provided in a RAM.

10. A paper feeding apparatus for a printer utilizing cut sheet paper comprising a frame; a platen having an upstream side and a downstream side, said platen being rotatably supported on said frame; driving means for rotatably driving the platen; roller means located at the downstream side of the platen, said roller means being coupled to the driving means, said driving means driving said roller means to rotate with a circumferential speed greater than or equal to the circumferential speed of said platen, said roller means including at least one paper feed-out roller and a guide cover plate, said guide cover plate having a plurality of ribs extending therefrom, said ribs being disposed adjacent the paper feed-out roller with each rib being separated at a side from the paper feed-out roller by predetermined distance and each rib being disposed in a overlapping manner relative to said paper feed-out roller by a predetermined distance, so that friction applied by the roller means draws out the paper from the printer.

11. The paper feeding apparatus of claim 10, further comprising paper feeding means for feeding paper towards said platen, said paper feeding means being supported in the frame at the upstream side of the platen.

* * * * *